US005704508A

United States Patent [19]

Keip et al.

[11] Patent Number: 5,704,508

[45] Date of Patent: Jan. 6, 1998

[54] INTERLOCKING SHIPPING CONTAINER

[75] Inventors: Charles Paul Keip, Byron Center; Charles E. Decker, Grand Rapids, both of Mich.

[73] Assignee: K-D Container L.L.C., Grandville, Mich.

[21] Appl. No.: 715,874

[22] Filed: Sep. 19, 1996

[51] Int. Cl.[6] ..... B65D 6/24

[52] U.S. Cl. ..... 220/4.31

[58] Field of Search ..... 220/4.28, 4.31, 220/4.33, 7

[56] References Cited

U.S. PATENT DOCUMENTS 2,775,360 12/1956 Phillips .

4,785,957 11/1988 Beck et al. .

4,809,851 3/1989 Oestreich, Jr. et al. .

4,917,255 4/1990 Foy et al. .

5,161,709 11/1992 Oestreich, Jr. .

5,413,236 5/1995 Kenevan .

*Primary Examiner*—Joseph M. Moy

*Attorney, Agent, or Firm*—Harpman & Harpman

[57] ABSTRACT

A modular parts container including multiple upstanding side panels registerable to a platform having a generally flat supporting surface with perimeter panel engaging recesses to receive elongated tabs extending from the side panels. The panels have interlocking end fittings slideably disposed within one another for progressive selective interengagement. The platform has multiple support legs in staggered spaced side by side relationship. Panels can be stocked one on another and selectively removed for container access and tear down.

10 Claims, 5 Drawing Sheets

INTERLOCKING SHIPPING CONTAINER

BACKGROUND OF THE INVENTION

1. Technical Field

This invention relates to knock down containers used in manufacturing facilities to store and transport materials. The invention is directed to a modular container that is stackable upon one another in fixed relation thereto.

2. Description of Prior Art

Prior art devices of this type have relied on a variety of construction configurations to address the problem of supplying components to manufacturing plants and removal of finished goods. A number of containers have been developed such as single use containers, made of wood or reinforced compressed paper that are disposable after a single use. More durable containers have been developed that can be taken apart for reshipment to a supplier or for storage. Such containers typically have metal or composite walls with latches or hinged pivot pins to allow quick disassembly to generally flat components, such examples can be seen in U.S. Pat. Nos. 2,775,360, 4,785,957, 4,809,851, 4,917,255, 5,161,709 and 5,413,236.

In the U.S. Pat. No. 2,775,360 a material handling container can be seen having a base with corner posts therebetween which are mounted on multiple side plates.

U.S. Pat. No. 4,785,957 is directed to a collapsible shipping container having a plurality of retainer weld elements forming upper and lower pocket means therein positioned on a base.

U.S. Pat. No. 4,809,851 discloses a collapsible container having a support base with multiple upstanding wall panels extending therefrom. The panels are slideably secured to one another and the base by tenons.

U.S. Pat. No. 4,917,255 a collapsible container is illustrated having multiple interlocking side and walls by a flange and locking tab construction.

U.S. Pat. No. 5,161,709 is directed towards a collapsible container having a flat base with pairs of engageable upstanding panels extending therefrom. The panels are secured to one another by catches having multiple bolts, interengaging the respective panels.

U.S. Pat. No. 5,413,236 is a modular shipping container having a base, multiple corner posts and inter-disposed panels therebetween. The top is registerable over the post and can be interlocked to adjacent containers by a plurality of interlocking tabs disposed around its perimeter edge.

SUMMARY OF THE INVENTION

This invention provides a container formed of multiple interengaging side panels extending from a platform element. The panels are secured to one another by interengaging tabs and slots. The platform has multiple feet that can be interengaged to an opposing inverted platform element to provide multiple stacked containers of varying heights.

DESCRIPTION OF THE PREFERRED EMBODIMENT

Figure 1:
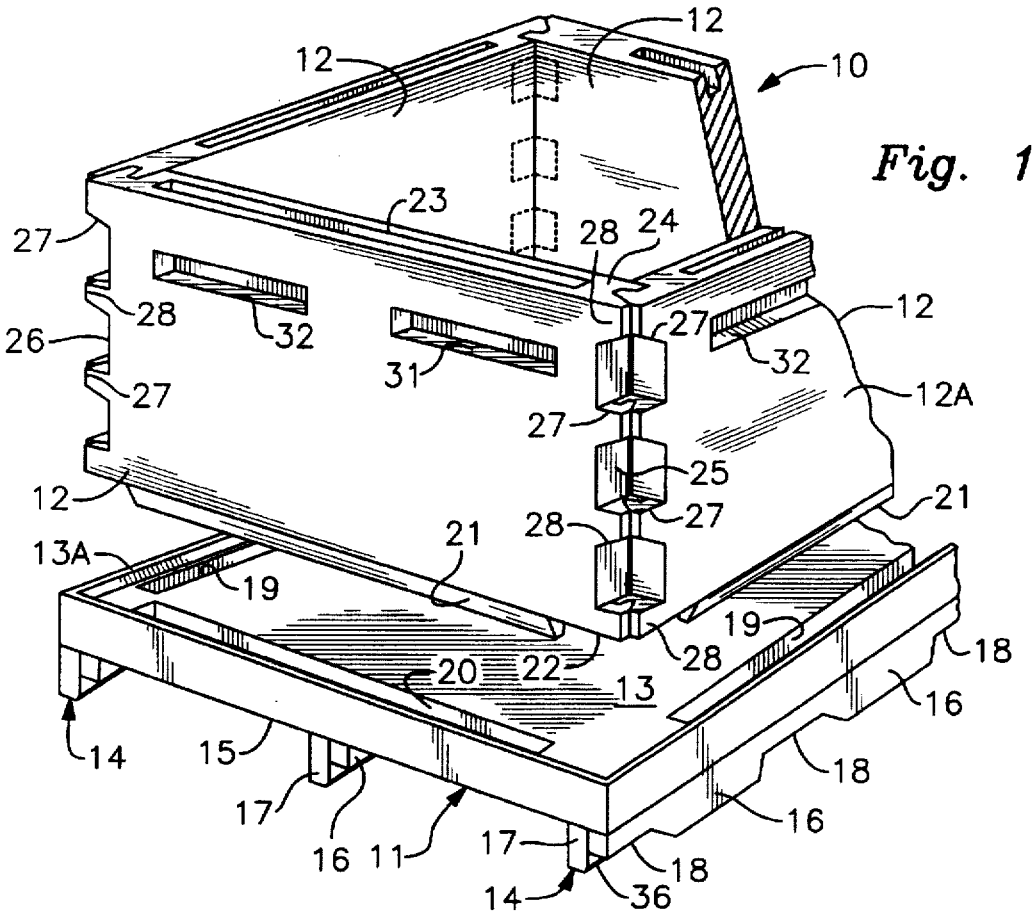
FIG. 1 is an exploded perspective view of the collapsible container of the invention with portions broken away.
Figure 2:
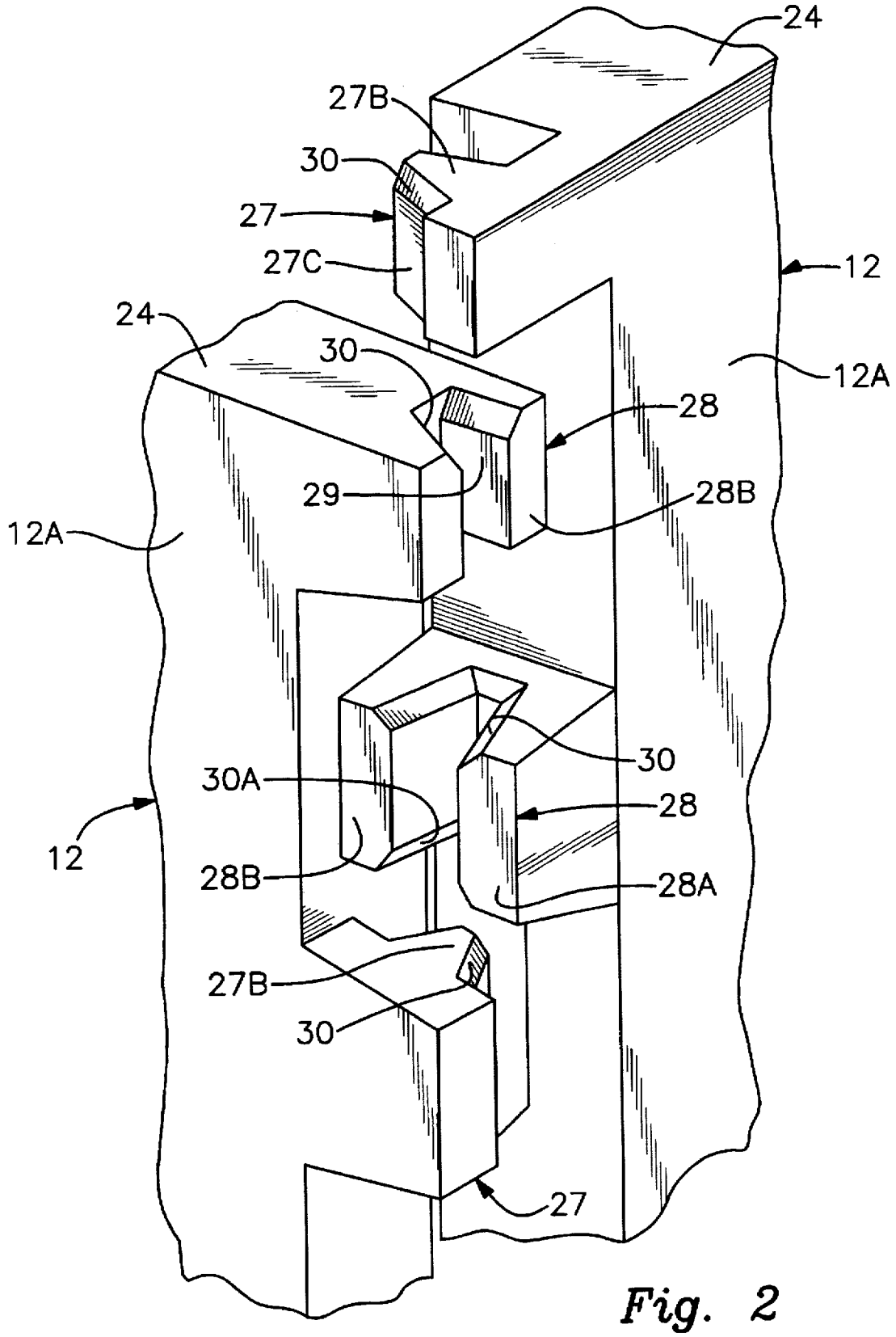
FIG. 2 is an enlarged partial perspective view of panels with interengaging tabs and slots thereon.
Figure 3:
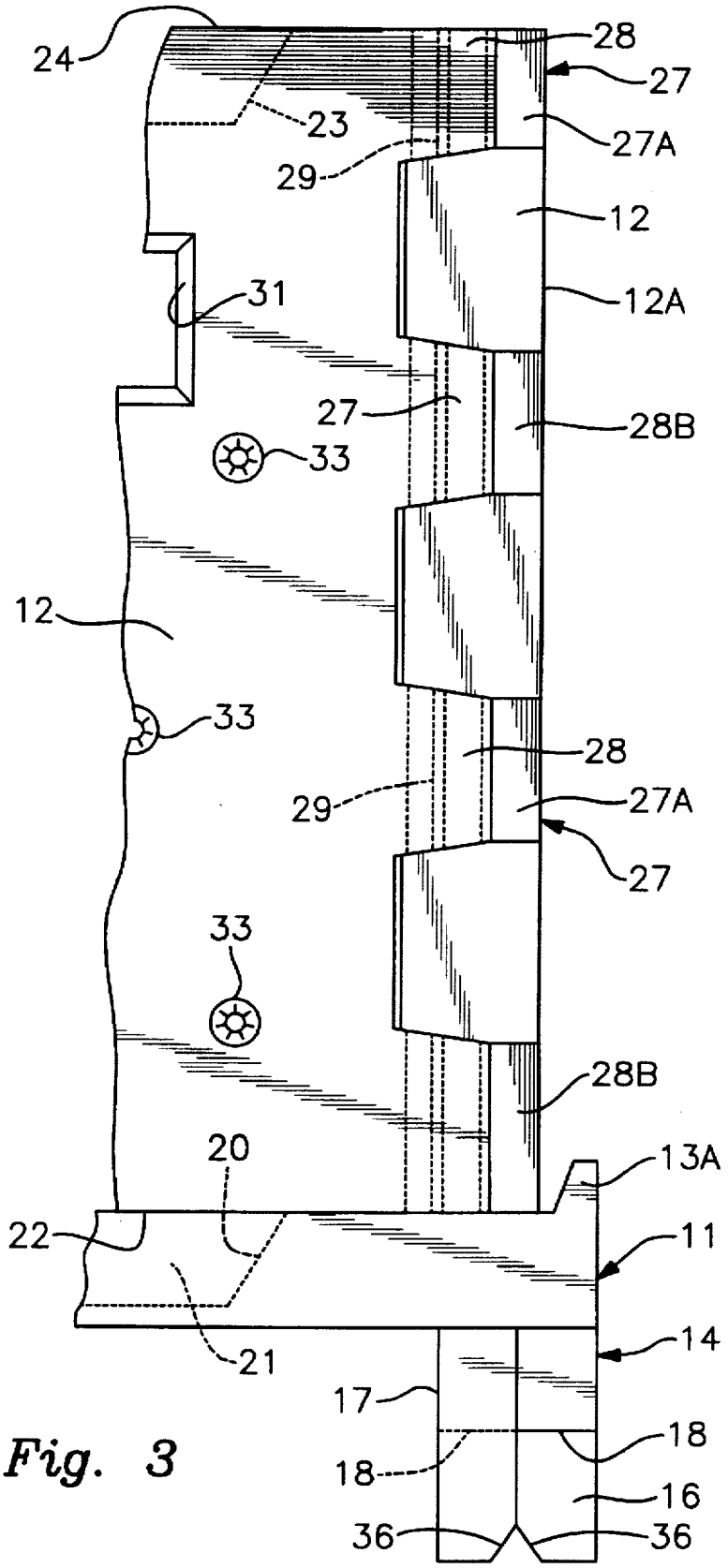
FIG. 3 is an enlarged side elevational view of the interengaging side panels and platform with portions broken away.

Referring now to FIGS. 1, 2 and 3 of the drawings a collapsible container 10 can be seen having a main support platform 11 with upstanding interconnected wall panels 12 extending therefrom.

The support platform 11 is generally square having a flat upper floor surface 13 with an upstanding perimeter edge lip 13A extending therefrom and multiple spaced parallel support rib feet assemblies 14 extending from a bottom surface 15.

Figure 7:
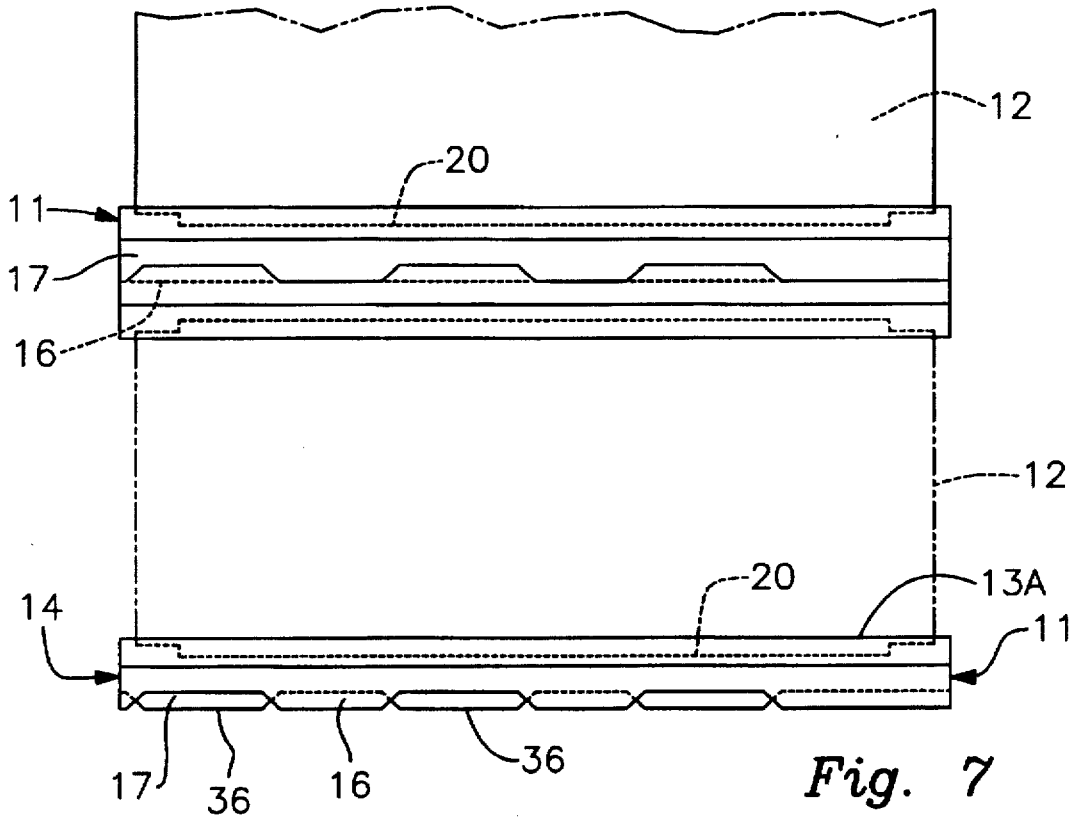
FIG. 7 is a side elevational view of an assembled container of the invention in stacked relationship with the wall panel shown in broken lines for clarity.
Figure 8:
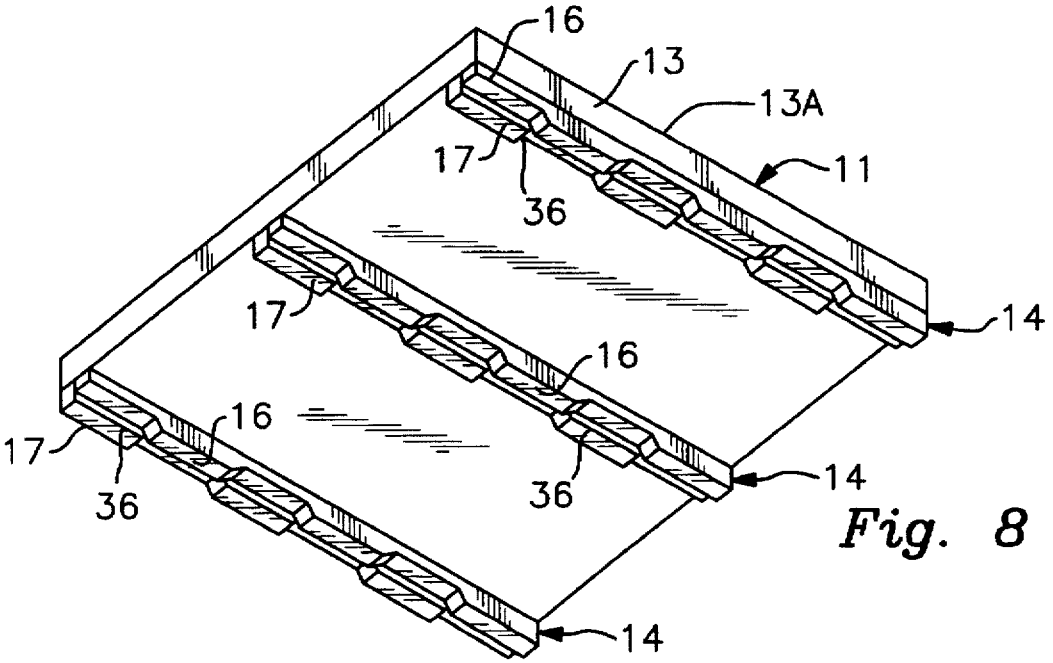
FIG. 8 is a bottom perspective view of the support platform illustrating the interlocking feet thereon.

Each of the rib feet assemblies 14 have rows of longitudinally spaced feet 16 and 17 extending therefrom with respective recessed areas 18 therebetween. The adjacent feet rows define alternate wave patterns therebetween that are out of phase so that the respective feet 16, for example, extend next to a corresponding recessed area 18 in the adjacent row. The staggered arrangement of the hereinbefore described rib feet assembly 14 provides for interengagement of the support platform 11 to another by inverting a registering platform as a top 11A to the container, as best seen in FIG. 7 of the drawings.

The upper surface 13 of the platform 11 has oppositely disposed pairs of channel recesses 19 and 20 inwardly of its perimeter edge lip for registration with the upstanding identical wall panels 12 which have corresponding elongated tenons 21 extending from a bottom edge 22 for registration within the respective channel recesses 19 and 20, best seen in FIGS. 1 and 3 of the drawings.

Each of the wall panels 12 have a corresponding channel recess 23 in a top edge 24 that is aligned with the hereinbefore described tenons 21 to allow multiple panels to be stacked directly on top of one another to extend the effect of height of the collapsible container 10. The panels 12 are secured to one another at their respective adjacent ends 25 and 26 by alternating tabs and slotted lug fittings 27 and 28 best seen in FIGS. 1, 2, and 3 of the drawings. The tabs 27 have an outstanding support arm 27A that is co-planar with the panel's respective outer side 12A. An engagement inner face 27B extends inwardly therefrom with a tapered oppositely disposed sides 27C. The corresponding slotted lug fitting 28 has a pair of outstanding engagement arms 28A and 28B with a tapered registration slot 29 formed therebetween. The positioning of the alternating tabs and slotted lug fittings 27 and 28 are critical to the scope and nature of the invention as described herein. The tabs and slotted lug fittings 27 and 28 extend along the panel end 26 beginning at the bottom edge 22 with a lug 28 progressively therealong in alternating fashion to terminate with a tab fitting 27 adjacent the top edge 24 of the panel 12, best seen in FIG. 3 of the drawings.

Correspondingly, the tabs and slotted lug fittings 27 and 28 along the panel's opposite end 25 begin at the bottom edge 22 with a tab 27 so as to be registerable with an adjacent panel end lug 28 to form an interlocking connection between respective panel ends defining a walled enclosure on the support platform 11 as seen in FIG. 1 of the drawings.

To provide ease of assembly, the relative vertical dimension of the tabs and slotted lug fittings 27 and 28 vary along the respective panel edges 25 and 26 with the largest dimensional fitting always adjacent the bottom edge 22 of the panel 12 and progressively diminishing to the smallest dimension adjacent the top edge 24 of the panel 12.

Additionally, to facilitate the insertion of the tabs in progressive relation into the slotted lugs the leading upper edges of the fittings 27 and 28 are tapered at 30 or alternately fittings 28 are tapered on the upper and lower edges at 30A defining a "lead in" for the respective corresponding tabs or lugs of the adjacent panel ends during insertion as best seen in FIG. 2 of the drawings. Accordingly, the registration of like size tabs and lugs will also occur with the insertion or removal of any panel within the assembly possible due to the progressive engagement of the respective tabs and slotted lugs on each of the panel configurations.

To afford assembly or removal, the panels 12 each have a pair of recessed hand holds 31 and 32 spaced inwardly from said top edge 24 in spaced longitudinal aligned relation in its respective outer surface 12A.

Figure 5:
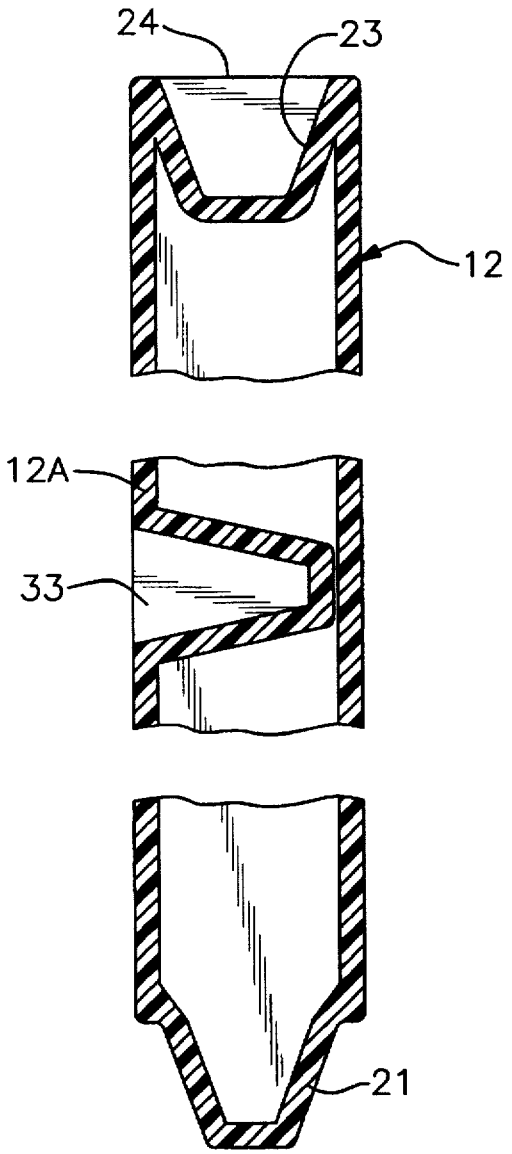
FIG. 5 is an enlarged partial cross-section of a wall panel of the invention.

Referring now to FIG. 5 of the drawings, a cross-section of the preferred panel 12 construction can be seen of a molded synthetic resin material having a hollow configuration with a plurality of spacing and reinforcing elements 33 molded in the outer surface 12A. The reinforcing elements are of a fusto-conical shape imparting structural rigidity between the opposing wall surfaces of the panel.

Figure 6:
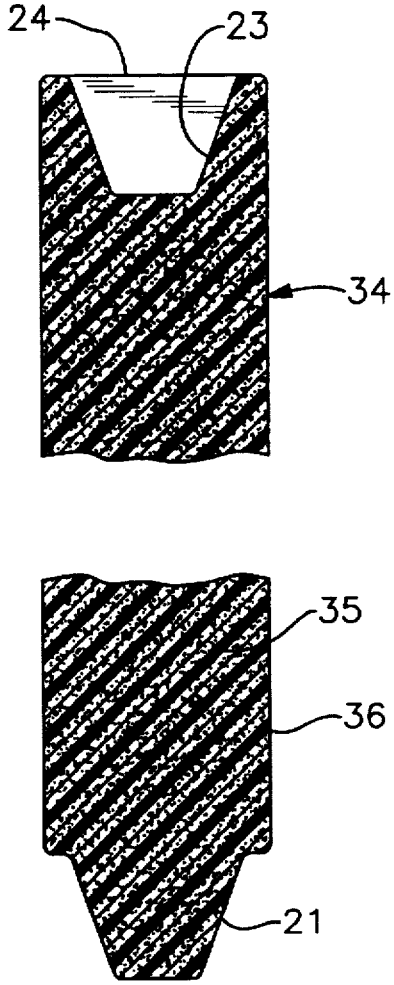
FIG. 6 is an enlarged partial cross-section of an alternate wall panel of the invention.

Referring to FIG. 6 of the drawings, an alternate panel construction 34 can be seen having a solid synthetic resin expanded foam core 35 with an outer skin 36 having a dense smooth surface typical of a molded solid core molding process well known to those skilled in the art. Such alternate solid core panel requires no additional interior support and is self-supporting in nature.

Figure 4:
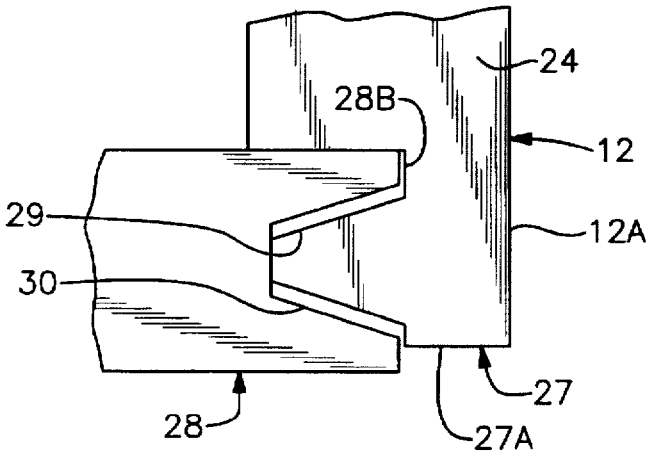
FIG. 4 is an enlarged top plan view of the interengaging tabs and slots of the panels with portions broken away.

Referring back now to FIGS. 1, 2, and 4 of the drawings it will be seen that as joined the respective tabs 27 are inserted progressively in the slotted lugs 28 overlapping the respective lug arms 28A and 28B defining a continuous corner joint surface co-planar with the respective adjoining panel outer surfaces 12A. Given the progressive size differential of the fittings 27 and 28, the relative spacing therebetween is variable which allows for the initial positioning of the opposing fittings 27 and 28 to be joined therein as illustrated in FIG. 2 of the drawings.

Once assembled, the collapsible container 10 can be stacked vertically upon itself by inverting a support platform 11A over the free top edges 24 of the panels 12 forming a closure thereon as best seen in FIG. 7 of the drawings. Accordingly, another collapsible container 10 can be registerably positioned thereon by interference of the previously described rib feet assembly 16 where alternating feet interlock to opposing feet in the staggered wave configuration. To assist with the interlock of the opposing rib feet assemblies 14, the feet rows have affronting tapers 36 along their respective inner edges, as seen in FIG. 3 of the drawings providing a "lead in" for registration thereof.

It will thus be seen that a new and novel modular collapsible container has been illustrated and described and it will be apparent to those skilled in the art that various changes and modifications may be made therein without departing from the spirit of the invention.

Therefore I claim:

1. A collapsible container for transportation and storage comprises; a platform having a generally planar support surface, leg assemblies extending from said platform opposite said support surface, channel recesses in said support surface, multiple identical wall panels on said support surface, a tenon extending from the bottom edge of each of said wall panels for upright registration within said respective channel recesses, said wall panels having upright edges in edge to edge contact, each of said identical wall panels having alternating pairs of oppositely disposed tabs and slotted lug fittings along their respective upright edges, said tabs and slotted lug fittings progressively simultaneously registerable within said respective tabs and slotted lug fittings of said wall panels adjacent upright edges, means for interengagement of opposing leg assemblies, and means for stacking of said wall panels.

2. The collapsible container of claim 1 wherein said channel recess are spaced inwardly of the perimeter edge of said platform.

3. The collapsible container of claim 1, wherein said leg assemblies are positioned adjacent the perimeter edge of said platform and therebetween for ease of container manipulation by mechanical means.

4. The collapsible container of claim 1, wherein said tabs and slotted lugs are in spaced aligned alternating position on said respective upright edges of said panels, and are in oppositely disposed registration opposition on said panels respective upright edges.

5. The collapsible container of claim 1 wherein said progressive registration between said tabs and slotted lug fittings comprises; each of said respective tabs and slotted lug fittings having a different engagement dimension and tapered edges thereon.

6. The collapsible container of claim 5, wherein said tabs and slotted lug engagement dimensions are incrementally progressively increased along each upstanding panel edge, and wherein registration between said tab fittings and corresponding slotted lug fittings are dimensionally the same.

7. The collapsible container of claim 1, wherein said means for interengagement of opposing leg assemblies comprises; a first row of longitudinally spaced feet extending from said platform, a second row of longitudinally spaced feet adjacent said first row in longitudinally offset relation thereto, defining an alternate wave pattern between said respective adjacent feet.

8. The collapsible container of claim 7, wherein said rows of longitudinally spaced feet of said first row of said leg assembly are registerable with opposing interengaging longitudinally offset feet of said second row of an inverted leg assembly positioned on corresponding interconnected wall panels.

9. The collapsible container of claim 1 wherein said means for stacking of said wall panels comprises; an elongated recess in the top edge of said wall panels, said tenons on said bottom edge of said wall panels registerable within said elongated recesses in said wall panels.

10. The collapsible container of claim 1 wherein said platform extends beyond said panel registration within said channel recesses and wherein said platform has an upstanding lip about its perimeter edge support surface.

* * * * *